US006149515A

United States Patent [19]

Van Becelaere

[11] Patent Number: 6,149,515

[45] Date of Patent: Nov. 21, 2000

[54] COMBINATION MOISTURE ELIMINATION LOUVER AND AIR FLOW SENSOR AND METHOD

[75] Inventor: Robert M. Van Becelaere, Lake Lotawana, Mo.

[73] Assignee: Tomkins Industries, Inc., Grandview, Mo.

[21] Appl. No.: 09/173,870

[22] Filed: Oct. 16, 1998

[51] Int. Cl.[7] ..... F24F 11/02

[52] U.S. Cl. ..... 454/277; 73/198; 73/861.66

[58] Field of Search ..... 454/194, 271, 454/277, 279, 309; 73/198, 861.65, 861.66

[56] References Cited

U.S. PATENT DOCUMENTS

| | | | |
|---|---|---|---|
| 2,336,209 | 12/1943 | Anderson | 73/198 |
| 3,287,973 | 11/1966 | Liebermann et al. | 73/198 X |
| 3,596,442 | 8/1971 | Neumann . | |
| 3,953,183 | 4/1976 | Regehr . | |
| 4,576,088 | 3/1986 | Mathewes et al. | 454/194 |
| 4,594,888 | 6/1986 | DeBaun et al. | 73/198 |
| 4,989,502 | 2/1991 | Ospelt | 454/277 X |
| 5,379,792 | 1/1995 | Van Becelaere . | |
| 5,730,652 | 3/1998 | Van Becelaere . | |

*Primary Examiner*—Harold Joyce
*Attorney, Agent, or Firm*—Shughart Thomson & Kilroy P.C.

[57] ABSTRACT

A moisture elimination louver includes a housing which allows fluid flow between an air inlet opening on an upstream side of the housing and an air outlet opening on a downstream side of the housing with a plurality of moisture elimination separator plates positioned within the housing such that respective moisture eliminating air flow channels are formed between each adjacent pair of the separator plates. The moisture elimination louver is modified to included one or more air flow sensors by positioning each of the air flow sensor(s) within a different respective one of the air flow channels.

16 Claims, 2 Drawing Sheets

Fig.1.
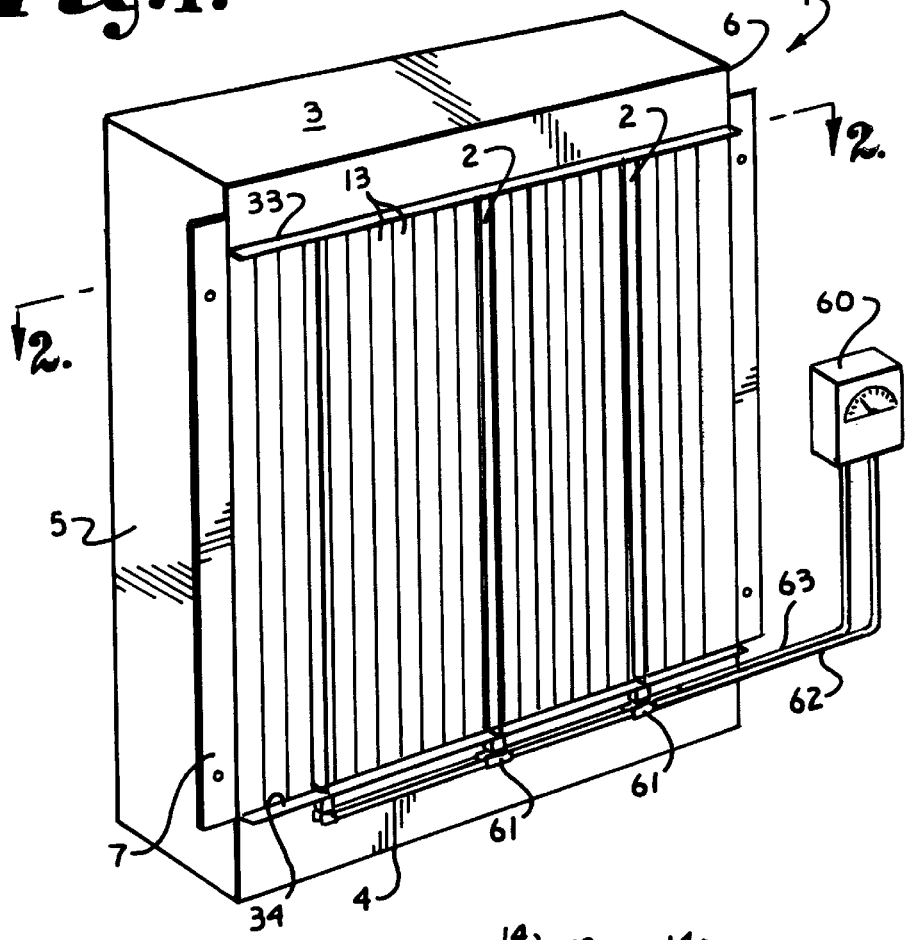
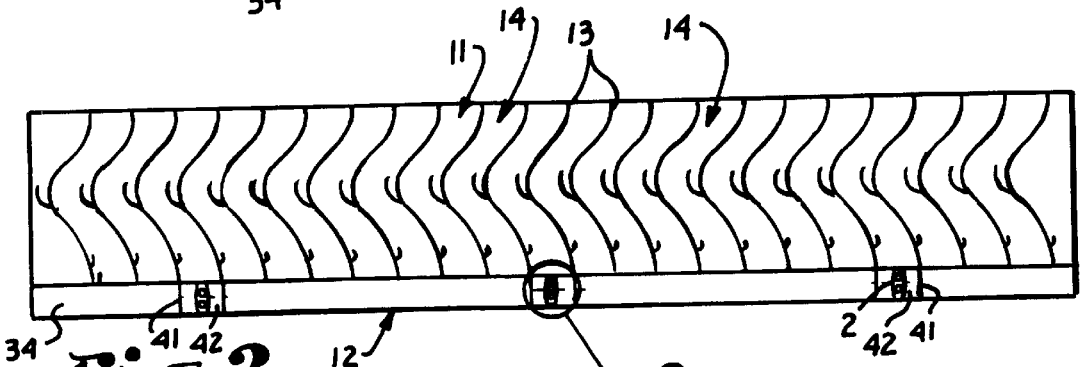
Fig.2.

COMBINATION MOISTURE ELIMINATION LOUVER AND AIR FLOW SENSOR AND METHOD

FIELD OF THE INVENTION

The present invention relates to a combination moisture elimination louver and air flow sensor and method, and, more particularly, to such a system in which a moisture elimination louver is provided with a plurality of air flow sensing vanes, each of which is positioned within a different respective moisture eliminating air flow channel formed between adjacent pairs of moisture elimination plates.

BACKGROUND OF THE INVENTION

Heating and Air Conditioning (HVAC) systems for modern buildings and factories are generally precisely regulated to control the amount of outside air introduced into the system. In such systems, the designer must balance the need for energy conservation, which entails minimizing the amount of new outside air which must be introduced, and therefore heated or cooled, vs. the competing need for adequate fresh air ventilation to prevent the accumulation of stale air and the accompanying effects of so-called "sick building syndrome" on occupants.

Typically, in such controlled HVAC systems, outside air is introduced via selectively controllable dampers. For example, a damper can be a rectangular frame built into a wall communicating with the exterior of the building. Within the rectangular frame, a plurality of rotatable vanes are positioned, which vanes are selectively rotatable between a vertically oriented, completely closed position at which no air is introduced, and a substantially horizontally oriented, completely open position at which maximum air is introduced. Between these extreme positions are an infinite number of intermediate, partially open positions.

It is also common to associate a moisture and particle elimination louver with the controllable damper at the air inlet to an HVAC system. Conventional moisture elimination louvers have a disadvantage of presenting a substantial resistance to air flow and thus significantly lowering the potential air velocity through the louver. For example, a typical moisture elimination louver will restrict air flow to a maximum of 500 FPM face velocity. Minimum velocities are typically about 20% of maximum, or 100 FPM.

In order to accurately control the amount of ambient air introduced into a building, the air flow must be measured. The conventional method of sensing air flow is to place a pitot static sensor in the air stream to measure the difference between the upstream and the downstream pressures to determine the differential or velocity pressure. The velocity pressure is proportional to air flow according to the relationship:

$$\text{Velocity Pressure}=(\text{Velocity(FPM)}/4005)^2$$

However, a practical limit of instrumentation is a velocity pressure of 0.02. With pressures less than this, instrumentation sensitivity does not allow accurate measurement. Therefore, with conventional moisture elimination louvers, with air flow rates of from 100 to 500 FPM face velocity, doubled within the louvers to 200 to 1000 FPM velocity pressures would vary between 0.0025 and 0.0625. Even with air measurement systems which amplify sensed velocity pressure by 3:1, the minimum air flows are well below accurately measurable limits.

It is clear then, that a need exists for an improved system and method for associating differential or velocity air pressure sensors with moisture elimination louvers in a manner such that they can reliably detect velocity pressure at virtually all levels of air flow through the louver.

SUMMARY OF THE INVENTION

The present invention is directed to a combination moisture elimination louver and air flow sensor in which an improved moisture elimination louver similar to that shown and described in U.S. Pat. No. 3,953,183 to Ulrich Regehr, and entitled APPARATUS FOR SEPARATING MATERIAL PARTICLES FROM GASSES, is used as an air inlet into a facility. Typically such moisture elimination louvers are used upstream of one or more controllable dampers which are used to regulate air flow into the facility. The louver described in the Regehr patent includes a plurality of spaced, parallel separator plates which define "wave-like" moisture elimination air flow channels between adjacent plates with each channel including one or more separating chambers which separate moisture and other particles out of the air stream. This type of moisture elimination louver is a very efficient flow through system, allowing maximum air flows with a face velocity of approximately 1100 FPM, and minimum face velocities of approximately 220 FPM. Due to restrictions within the louver, these face velocities are approximately doubled within each air flow channel. Positioned within one or more of the channels, downstream from the separating chambers, are respective stationary pitot static air flow sensing vanes. These vanes are similar to, but much narrower than the stationary pitot static tube vanes shown and described in U.S. Pat. No. 5,730,652, ("the '652 patent") issued Mar. 24, 1998 to the present inventor and entitled DAMPER WITH STATIONARY PITOT-STATIC SENSING VANES, which patent is hereby incorporated by reference. Each of the pitot static vanes is shaped as an air foil and acts as a pitot static sensor with an upstream pitot chamber connected to an upstream pitot aperture and a downstream static chamber connected to a downstream static aperture. Each of the chambers is connected to a manometer for generating a differential pressure readout, which can then be used to calculate air flow. In addition to the amplification achieved in the louver air flow channels, the pitot static sensing vanes themselves achieve an amplification of approximately 3:1, which allows even minimum air flow through the moisture eliminating louvers to be reliably measured.

OBJECTS AND ADVANTAGES OF THE INVENTION

The principal objects of the present invention include: providing a combination moisture elimination louver and air flow sensor; providing such a louver and air flow sensor which presents minimal resistance to air flow; providing such a louver and air flow sensor in which air flow is reliably sensed from minimum to maximum flow rates; providing such a louver and air flow sensor which is economical, yet highly effective at minimizing moisture while reliably sensing air flow; and providing such a louver and air flow sensor which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a combination moisture elimination louver and air flow sensor in accordance with the present invention, shown with a plurality of air flow sensing vanes connected, in series, to a manometer.

FIG. 2 is a cross sectional view of the moisture elimination louver and air flow sensor, taken along line 2—2 of FIG. 1.

DETAILED DESCRIPTION OF THE INVENTION

Figure 3:
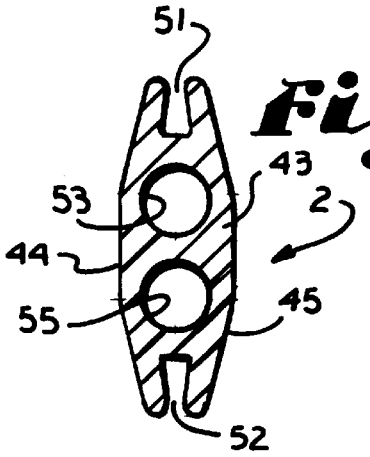
FIG. 3 is a greatly enlarged view of one of the air flow sensing vanes, as highlighted in the circled area marked as "3" in FIG. 2.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–5, the reference numeral 1 generally indicates a moisture elimination louver equipped with a plurality of pitot-static air flow sensing vanes 2. The louver 1 includes a housing with a top wall 3, a bottom wall 4, and respective left and right side walls 5 and 6. Each of the side walls 5 and 6 abuts a mounting flange 7. The housing forms an inlet opening 11 and an outlet opening 12, between which are positioned a plurality of spaced, parallel separator plates 13 which define "wave-like" flow channels 14 between adjacent ones of the plates 13.

Figure 5:
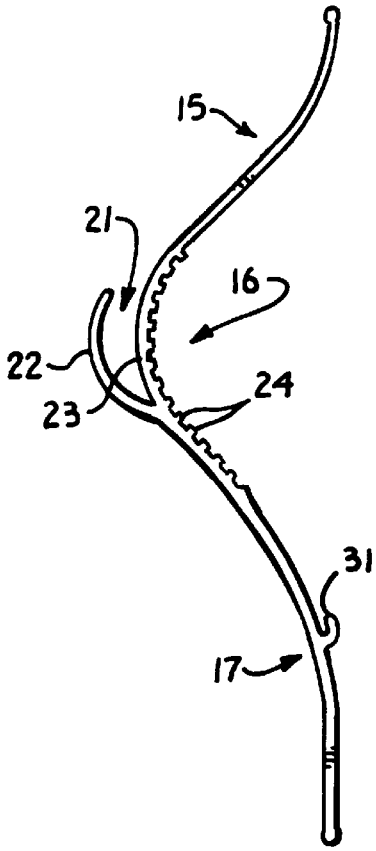
FIG. 5 is a greatly enlarged, detail view of one of the wave-shaped separator plates in the moisture elimination louver.
Figure 4:
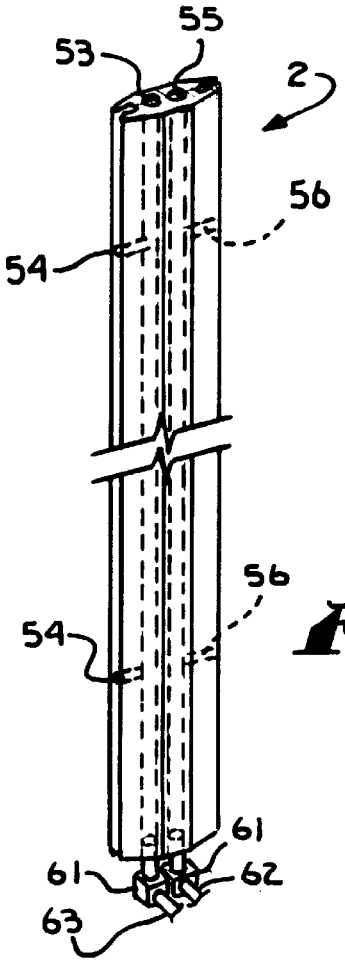
FIG. 4 is a greatly enlarged, fragmentary perspective view of one of the air flow sensing vanes, with respective pitot and static orifices connecting to respective pitot and static pressure chambers indicated in phantom lines.

Referring to FIG. 5, each separator plate 13 is shaped as a complex curve with arcs 15, 16 and 17 of three separate radii which result in the overall wave shape. A first separating chamber 21 is formed by a blade 22 which projects upward from a downstream side of a crest 23 and follows the contour of the crest 23 to the upstream side thereof. Particles, including moisture droplets, are separated from the air stream by turbulence created by these upward projecting blades 22 and a number of serrations 24 formed in the bottom side of each plate 13 immediately opposite the blade 22. An additional, smaller separation chamber 31 is provided downstream of the crest 23 to capture any particles which remain after the first separating chamber 21.

Each of the air flow sensing vanes 2 is positioned between respective upper and lower flanges 33 and 34 which extend outward and horizontally across the top and bottom, respectively, of an air outlet opening 12 on the downstream side of the louver 1. Each of the pitot static sensing vanes 2 is positioned in a substantially vertical orientation between a respective pair of extensions 41 which protrude outward from respective ones of the separator plates 13 and which, together with the upper and lower flanges 33 and 34, respectively, form individual air channel extensions 42 surrounding each of the sensing vanes 2. Each of the pitot static sensing vanes 2 is shaped as a symmetrical air foil, as shown in greater detail in FIGS. 3 and 4. Each pitot static sensing vane 2 includes a solid core 43 with opposing curved sidewalls 44 and 45 with the sidewalls 44 and 45 extending past the core 43 to form respective slots 51 and 52. A pitot pressure sensing chamber 53 is formed in the core 43, which chamber 53 is preferably cylindrical in shape. A plurality of pitot orifices 54 are formed in the upstream end of each vane 2 with the pitot orifices 54 communicating with the pitot chamber 53. A static sensing chamber 55 is formed in the core 42, which chamber 55 is also preferably cylindrical in shape. A plurality of static air orifices 56 are formed in the downstream end of each vane 2 with the orifices 56 communicating with the static chamber 55. The pitot static sensing vanes 2 can be made by extruding aluminum into the required shape.

The static chambers 55 of each pitot static sensing vane 2 are connected, in series, to a manometer 60 via respective fittings 61 connected to a static pressure line 62 while the pitot chambers 53 of each sensing vane 2 are connected, in series, to the manometer 62 via other respective fittings 61 connected to a pitot pressure line 63.

The pressure sensed in the pitot pressure line 63 constitutes both velocity and static pressure while the pressure sensed in the static pressure line 62 constitutes static pressure only. The difference between the two sensed pressures is the differential or velocity pressure, which can be used by an operator to adjust air flow through an HVAC or other fluid control system. The measured velocity, as determined by the pitot-static sensing vanes 2 is multiplied by a factor of 3 or more over the actual velocity. This is presumably due to downstream turbulence about the pitot-static sensing vanes 2, but this amplification of measured velocity, plus the increased air flow speed through the restricted channels 14, 42 are useful to enhance air flow sensing accuracy. The inventive louver 1 has been illustrated and described as being of use for a fresh air inlet for an HVAC system, but it would be equally useful in other applications, such as for moisture elimination and flow sensing through any opening where fluid flow needs to be regulated. The specific shape of the sensing vanes 2 and the separator plates 13 are representative, and other shapes might be successfully used as well. The number and spacing of the air flow sensing vanes 2 is merely representative and more or fewer such sensing vanes can be used.

It is thus to be understood that while certain forms of the present invention have been illustrated and described herein, it is not to be limited to the specific forms or arrangement of parts described and shown.

What is claimed and desired to be secured by Letters Patent is as follows:

1. A moisture elimination louver with air flow sensor, comprising:

a. a housing which allows fluid flow between an air inlet opening on an upstream side of said housing and an air outlet opening on a downstream side of said housing;

b. a plurality of moisture elimination separator plates positioned within said housing with respective moisture eliminating air flow channels formed between each adjacent pair of said separator plates; and c. at least one air flow sensor positioned in said housing in flow communication with a respective one of said air flow channels.

2. A moisture elimination louver with air flow sensor as in claim 1, wherein there are a plurality of air flow sensors positioned in said housing, with each of said air flow sensors being positioned in flow communication with a different respective one of said air flow channels.

3. A moisture elimination louver with air flow sensor as in claim 1, wherein said housing includes an upper flange extending outward above said air outlet opening and a lower flange extending outward below said air outlet opening, and wherein said air flow sensor extends between said upper and lower flanges.

4. A moisture elimination louver with air flow sensor as in claim 1, said air flow sensor comprising:

a. a pitot chamber with a first orifice connecting said pitot chamber to said channel upstream of said air flow sensor; and b. a static chamber with a second orifice connecting said static chamber to an area downstream of said air flow sensor.

5. A moisture elimination louver with air flow sensor as in claim 4, wherein said air flow sensor is shaped as a symmetrical airfoil with a pair of opposing surfaces tapering toward each other on both the upstream and the downstream side of said air flow sensor with an upstream slot and a downstream slot formed between said two sides.

6. A moisture elimination louver with air flow sensor as in claim 5, wherein said first orifice is formed in said upstream slot and said second orifice is formed in said downstream slot.

7. A moisture elimination louver with air flow sensor as in claim 4, wherein there are a plurality of air flow sensors positioned within said housing, with each of said air flow sensors being positioned in flow communication with a different respective one of said air flow channels.

8. A moisture elimination louver with air flow sensor as in claim 4, and further comprising a differential pressure sensor connected to said pitot chamber and to said static chamber.

9. A moisture elimination louver with air flow sensor, comprising:

a. a housing which allows fluid flow between an air inlet opening on an upstream side of said housing and an air outlet opening on a downstream side of said housing;

b. said housing including an upper flange extending outward above said air outlet opening and a lower flange extending outward below said air outlet opening;

c. a plurality of moisture elimination separator plates positioned within said housing with respective moisture eliminating air flow channels formed between each adjacent pair of said separator plates;

d. at least one air flow sensor positioned in a respective one of said air flow channels and extending between said upper and lower flanges;

e. the pairs of separator plates which form the channel within which said air flow sensor is placed being extended outward beyond said air outlet opening to form, with said upper and lower flanges, an air flow channel extension of the air flow channel between those plates; and f. said airflow sensor being positioned within said air flow channel extension.

10. A moisture elimination louver with air flow sensor, comprising:

a. a housing which allows fluid flow between an air inlet opening on an upstream side of said housing and an air outlet opening on a downstream side of said housing;

b. said housing including an upper flange extending outward above said air outlet opening and a lower flange extending outward below said air outlet opening;

c. a plurality of moisture elimination separator plates positioned within said housing with respective moisture eliminating air flow channels formed between each adjacent pair of said separator plates;

d. a plurality of air flow sensors with each said sensor being positioned in a different respective one of said air flow channels and extending between said upper and lower flanges;

e. the pairs of separator plates which form the respective channels within which said air flow sensors are placed being extended outward beyond said air outlet opening to form, with said upper and lower flanges, air flow channel extensions of the air flow channels between those plates; and f. each of said air flow sensors being positioned within a respective one of said air flow channel extensions.

11. A moisture elimination louver with air flow sensor as in claim 10, wherein each said air flow sensor comprises:

a. a pitot chamber with a first orifice connecting said pitot chamber to said channel upstream of said air flow sensor; and b. a static chamber with a second orifice connecting said static chamber to an area downstream of said air flow sensor.

12. A moisture elimination louver with air flow sensor as in claim 11, wherein said air flow sensors are each shaped as a symmetrical airfoil with a pair of opposing surfaces tapering toward each other on both the upstream and the downstream side of said air flow sensor with an upstream slot and a downstream slot formed between said two sides.

13. A moisture elimination louver with air flow sensor as in claim 12, wherein, in each said air flow sensor, said first orifice is formed in said upstream slot and said second orifice is formed in said downstream slot.

14. A moisture elimination louver with air flow sensor as in claim 11, and further comprising a differential pressure sensor connected to said pitot chamber and to said static chamber.

15. A method of associating one or more air flow sensors with a moisture elimination louver, the moisture elimination louver including a housing which allows fluid flow between an air inlet opening on an upstream side of said housing and an air outlet opening on a downstream side of said housing and a plurality of moisture elimination separator plates positioned within said housing with respective moisture eliminating air flow channels formed between each adjacent pair of said separator plates, the method comprising the steps of:

a. adding an upper flange to said louver which extends outward above said air outlet opening and adding a lower flange to said louver which extends outward below said air outlet opening;

b. positioning at least one air flow sensor in a respective one of said air flow channels between said upper and lower flanges; and c. extending the pair of separator plates which form the channel within which said air flow sensor is placed outward beyond said air outlet opening to form, with said upper and lower flanges, an air flow channel extension of said air flow channel between those plates such that said air flow sensor is positioned within said air flow channel extension.

16. A method as in claim 15, wherein said positioning step comprises positioning a plurality of said air flow sensors with each of said air flow sensors being positioned within a different respective one of said air flow channels.

* * * * *